US007806664B2

(12) United States Patent
Patel et al.

(10) Patent No.: US 7,806,664 B2
(45) Date of Patent: Oct. 5, 2010

(54) BILGE PUMP

(75) Inventors: Anil B. Patel, La Crescenta, CA (US); Brian A. Babson, Fountain Valley, CA (US)

(73) Assignee: SHURflo, LLC, Cypress, CA (US)

( * ) Notice: Subject to any disclaimer, the term of this patent is extended or adjusted under 35 U.S.C. 154(b) by 1225 days.

(21) Appl. No.: 10/818,800

(22) Filed: Apr. 6, 2004

(65) Prior Publication Data

US 2004/0191090 A1 Sep. 30, 2004

Related U.S. Application Data

(63) Continuation of application No. 10/013,311, filed on Nov. 12, 2001, now Pat. No. 6,715,994.

(51) Int. Cl.
*F04B 49/04* (2006.01)

(52) U.S. Cl. ..... 417/40; 417/36

(58) Field of Classification Search ..... 417/360, 417/361, 424.1, 565.17, 36–40; 137/565.17
See application file for complete search history.

(56) References Cited

U.S. PATENT DOCUMENTS

| | | | |
|---|---|---|---|
| 1,609,915 | A | 12/1926 | Parker |
| 1,819,966 | A | 8/1931 | Olson |
| 1,982,958 | A | 12/1934 | Kraus |
| 2,016,802 | A | 10/1935 | Fick |
| 2,219,359 | A | 10/1940 | Goit et al. |
| 2,348,332 | A | 5/1944 | Craig et al. |
| 2,413,670 | A | 12/1946 | Willson |
| 2,462,044 | A | 2/1949 | Willson |
| 2,488,506 | A | 11/1949 | Bernhardt |
| 2,573,863 | A | 11/1951 | Mitchell |
| 2,677,966 | A | 5/1954 | Mueller |
| 2,680,412 | A | 6/1954 | Entwistle |
| 2,765,743 | A | 10/1956 | Hollinshead |

(Continued)

FOREIGN PATENT DOCUMENTS

| | | |
|---|---|---|
| DE | 509224 | 10/1930 |

(Continued)

OTHER PUBLICATIONS

Shurflo Service Manual, Jun. 1977.

(Continued)

*Primary Examiner*—Michael Cuff
*Assistant Examiner*—Vikansha S Dwivedi
(74) *Attorney, Agent, or Firm*—Greenberg Traurig, LLP

(57) ABSTRACT

A bilge pump having a mounting member adapted to be mounted to a vessel and a base movably engageable with the mounting member and positionable in at least two positions relative to the mounting member. A housing is releasably coupled to the base and defines a cavity for receiving a motor. A locking ring is engageable with the motor and the housing to secure the motor in the cavity while allowing the motor to be movable with respect to the housing. The cavity in the housing communicates with an outlet portion defining a socket. An outlet nozzle having an outlet end is movably received in the socket so that the outlet end can be moved relative to the housing. These features can be employed individually or in combination to make the bilge pump highly adaptable, thereby facilitating installation.

4 Claims, 6 Drawing Sheets

U.S. PATENT DOCUMENTS

| | | | | |
|---|---|---|---|---|
| 2,797,647 | A | | 7/1957 | Floraday |
| 2,804,516 | A | | 8/1957 | Staak |
| 2,824,520 | A | | 2/1958 | Bartels |
| 2,920,574 | A | | 1/1960 | Sampietro |
| 2,926,735 | A | | 3/1960 | Cook |
| 2,929,333 | A | | 3/1960 | Harry |
| 2,931,311 | A | | 4/1960 | Ulm et al. |
| 2,942,550 | A | | 6/1960 | Carter |
| 2,969,745 | A | | 1/1961 | Johnson et al. |
| 2,971,470 | A | | 2/1961 | Wein et al. |
| 2,991,723 | A | | 7/1961 | Zubaty |
| 2,996,994 | A | | 8/1961 | Wright |
| 3,010,339 | A | | 11/1961 | Brock |
| 3,010,403 | A | | 11/1961 | Zubaty |
| 3,043,225 | A | | 7/1962 | Nielsen |
| 3,077,118 | A | | 2/1963 | Robbins |
| 3,095,824 | A | | 7/1963 | Elfes |
| 3,143,971 | A | | 8/1964 | Green |
| 3,199,531 | A | | 8/1965 | Cornelius et al. |
| 3,205,829 | A | | 9/1965 | Andersen et al. |
| 3,304,886 | A | | 2/1967 | Roberts |
| 3,314,600 | A | | 4/1967 | Hadley |
| 3,316,845 | A | | 5/1967 | Schumann |
| 3,318,249 | A | | 5/1967 | Loeser |
| 3,410,477 | A | | 11/1968 | Hartley |
| 3,411,450 | A | | 11/1968 | Clifton |
| 3,464,358 | A | | 9/1969 | Lind |
| 3,465,681 | A | | 9/1969 | Zimmerman |
| 3,496,872 | A | | 2/1970 | Reister et al. |
| 3,545,892 | A | | 12/1970 | Zimmerman |
| 3,552,886 | A | | 1/1971 | Olson, Jr. |
| 3,572,375 | A | | 3/1971 | Rosenberg |
| 3,572,980 | A | | 3/1971 | Hollyday |
| 3,606,597 | A | | 9/1971 | Russell |
| 3,684,400 | A | * | 8/1972 | Einerson et al. ..... 417/40 |
| 3,684,406 | A | | 8/1972 | Edwards |
| 3,698,287 | A | | 10/1972 | Martin |
| 3,712,759 | A | | 1/1973 | Olson, Jr. |
| 3,717,420 | A | | 2/1973 | Rachocki |
| 3,717,421 | A | | 2/1973 | Shaefer |
| 3,743,447 | A | | 7/1973 | Lynch |
| 3,748,066 | A | | 7/1973 | Sully et al. |
| 3,754,842 | A | | 8/1973 | Schlanzky |
| 3,781,925 | A | | 1/1974 | Curtis et al. |
| 3,800,205 | A | * | 3/1974 | Zalar ..... 318/482 |
| 3,834,840 | A | | 9/1974 | Hartley |
| 3,850,550 | A | | 11/1974 | Kaessen |
| 3,861,831 | A | | 1/1975 | Rule |
| 3,941,507 | A | | 3/1976 | Niedermeyer |
| 3,941,519 | A | | 3/1976 | McCauley |
| 3,973,471 | A | | 8/1976 | Hirmann |
| 4,013,384 | A | | 3/1977 | Oikawa |
| 4,047,847 | A | | 9/1977 | Oikawa |
| 4,153,391 | A | | 5/1979 | Hartley |
| 4,171,932 | A | | 10/1979 | Miller |
| 4,205,237 | A | | 5/1980 | Miller |
| 4,213,745 | A | | 7/1980 | Roberts |
| 4,242,061 | A | | 12/1980 | Hartley |
| 4,275,995 | A | | 6/1981 | Taylor |
| 4,305,702 | A | | 12/1981 | Hartley |
| 4,322,297 | A | | 3/1982 | Bajka |
| 4,371,316 | A | | 2/1983 | Ivic |
| 4,396,357 | A | | 8/1983 | Hartley |
| 4,428,688 | A | | 1/1984 | McGregor, Jr. |
| 4,486,151 | A | | 12/1984 | Korhonen-Wesala |
| 4,507,058 | A | | 3/1985 | Schoenmeyr |
| 4,515,531 | A | | 5/1985 | Roser |
| 4,518,316 | A | | 5/1985 | Yokota |
| 4,525,125 | A | | 6/1985 | Matsumoto et al. |
| 4,545,735 | A | | 10/1985 | Ims |
| 4,550,749 | A | | 11/1985 | Krikorian |
| 4,596,514 | A | | 6/1986 | Matsumoto et al. |
| 4,610,605 | A | | 9/1986 | Hartley |
| 4,611,529 | A | | 9/1986 | Stricker et al. |
| 4,628,302 | A | | 12/1986 | Barr et al. |
| 4,645,426 | A | | 2/1987 | Hartley et al. |
| 4,646,781 | A | | 3/1987 | McIntyre et al. |
| 4,678,403 | A | | 7/1987 | Rudy et al. |
| 4,678,409 | A | | 7/1987 | Kurokawa |
| 4,711,224 | A | | 12/1987 | Eckhardt |
| 4,738,185 | A | | 4/1988 | Kamimura |
| 4,743,169 | A | | 5/1988 | Funakawa et al. |
| 4,766,329 | A | | 8/1988 | Santiago |
| 4,776,776 | A | | 10/1988 | Jones |
| 4,797,069 | A | | 1/1989 | Hartley et al. |
| 4,863,355 | A | | 9/1989 | Odagiri et al. |
| 4,881,873 | A | | 11/1989 | Smith et al. |
| 4,943,210 | A | | 7/1990 | Bailey, Jr. et al. |
| 4,972,709 | A | | 11/1990 | Bailey, Jr. et al. |
| 5,004,535 | A | | 4/1991 | Bosko et al. |
| 5,064,347 | A | | 11/1991 | LaValley, Sr. |
| 5,076,763 | A | | 12/1991 | Anastos et al. |
| 5,099,181 | A | | 3/1992 | Canon |
| 5,129,794 | A | | 7/1992 | Beatty |
| 5,165,867 | A | | 11/1992 | Dockery |
| 5,203,803 | A | | 4/1993 | Schoenmeyr |
| 5,261,792 | A | | 11/1993 | Schoenmeyr |
| 5,263,825 | A | | 11/1993 | Doolin |
| 5,297,939 | A | | 3/1994 | Orth et al. |
| 5,301,663 | A | | 4/1994 | Small, Jr. |
| 5,316,447 | A | | 5/1994 | Fujii et al. |
| 5,322,421 | A | | 6/1994 | Hansen |
| 5,324,170 | A | | 6/1994 | Anastos et al. |
| 5,324,171 | A | | 6/1994 | Cook |
| 5,325,885 | A | | 7/1994 | Ivan et al. |
| 5,332,944 | A | | 7/1994 | Cline |
| 5,336,052 | A | | 8/1994 | Zöllner et al. |
| 5,340,282 | A | | 8/1994 | Milocco |
| 5,344,292 | A | | 9/1994 | Rabenau et al. |
| 5,365,220 | A | | 11/1994 | Rasmason |
| 5,404,048 | A | | 4/1995 | Panner |
| 5,410,150 | A | | 4/1995 | Teron et al. |
| 5,425,624 | A | | 6/1995 | Williams |
| 5,476,367 | A | | 12/1995 | Zimmermann et al. |
| 5,503,736 | A | | 4/1996 | Schoenmeyr |
| D371,293 | S | | 7/1996 | Schoenmeyr |
| 5,545,012 | A | | 8/1996 | Anastos et al. |
| 5,549,456 | A | | 8/1996 | Burrill et al. |
| D373,365 | S | | 9/1996 | Schoenmeyr |
| 5,571,000 | A | | 11/1996 | Zimmermann et al. |
| 5,585,025 | A | | 12/1996 | Idland |
| 5,586,862 | A | | 12/1996 | Danner |
| 5,601,112 | A | | 2/1997 | Sekiya et al. |
| 5,602,670 | A | | 2/1997 | Keegan |
| 5,613,838 | A | | 3/1997 | Newell |
| 5,615,597 | A | | 4/1997 | Schoenmeyr |
| 5,626,464 | A | | 5/1997 | Schoenmeyr et al. |
| 5,632,468 | A | | 5/1997 | Schoenmeyr |
| 5,649,812 | A | | 7/1997 | Schoenmeyr et al. |
| 5,658,457 | A | | 8/1997 | Schoenmeyr |
| 5,690,476 | A | | 11/1997 | Miller |
| 5,706,715 | A | | 1/1998 | Schoenmeyr |
| 5,722,339 | A | | 3/1998 | Gross |
| 5,725,359 | A | | 3/1998 | Dongo et al. |
| 5,730,861 | A | | 3/1998 | Sterghos et al. |
| 5,791,882 | A | | 8/1998 | Stucker et al. |
| 5,803,711 | A | | 9/1998 | Schoenmeyr |
| 5,809,796 | A | | 9/1998 | Zakryk |
| 5,816,133 | A | | 10/1998 | Schoenmeyr |
| 5,833,437 | A | | 11/1998 | Kurth et al. |
| 5,860,449 | A | | 1/1999 | Schulte |
| 5,898,958 | A | | 5/1999 | Hall |
| 6,003,166 | A | | 12/1999 | Hald et al. |
| 6,048,183 | A | | 4/2000 | Meza |

| | | | | |
|---|---|---|---|---|
| 6,059,536 | A | 5/2000 | Stingl | |
| 6,089,838 | A | 7/2000 | Schoenmeyr et al. | |
| 6,099,264 | A | 8/2000 | Du | |
| D441,767 | S | 5/2001 | Wolbers | |
| 6,227,808 | B1 | 5/2001 | McDonough | |
| 6,254,351 | B1 * | 7/2001 | Culp | 417/40 |
| 6,254,353 | B1 | 7/2001 | Polo et al. | |
| 6,296,218 | B1 | 10/2001 | Marra | |
| 6,299,414 | B1 | 10/2001 | Schoenmeyr | |
| 6,390,780 | B1 | 5/2002 | Batchelder et al. | |
| 2003/0017055 | A1 | 1/2003 | Fong | |

FOREIGN PATENT DOCUMENTS

| | | |
|---|---|---|
| DE | 932763 | 9/1955 |
| DE | 1129055 | 6/1956 |
| DE | 2308369 | 8/1974 |
| DE | 2743112 | 4/1979 |
| DE | 2926502 | 1/1981 |
| DE | 3824847 | 1/1990 |
| DE | 4110488 | 11/1991 |
| DE | 4244417 | 7/1994 |
| EP | 0065938 | 12/1982 |
| EP | 0093674 | 11/1983 |
| EP | 328075 | 2/1989 |
| EP | 0744547 | 11/1996 |
| FR | 909185 | 5/1946 |
| FR | 955857 | 1/1950 |
| FR | 1022273 | 3/1953 |
| FR | 1157249 | 5/1958 |
| FR | 1535864 | 7/1968 |
| FR | 2086857 | 12/1971 |
| GB | 468122 | 6/1937 |
| GB | 654636 | 6/1951 |
| GB | 861749 | 2/1961 |
| GB | 895256 | 5/1962 |
| GB | 1263057 | 2/1972 |
| GB | 2008873 | 6/1979 |
| IT | 585940 | 11/1958 |
| IT | 644086 | 8/1962 |
| JP | 4255593 | 9/1992 |

OTHER PUBLICATIONS

Product Brochure, "Sensor VSD", Flojet ITT Industries, 2001.
Product Brochure, "Aquajet RV Series", Aquajet, Mar. 3, 2000.
Product Brochure, "Sensor-Max VDS Water System", JABSCO, Jul. 2001.
Product Brochure, "Aquajet RV Pump", Aquatec Water Systems, Inc., Mar. 3, 2000.
Product Information Sheet "Switches", Aquatec Water Systems, Inc., Mar. 19, 2001.
Product Information Sheet "Marine", Aquatec Water Systems, Inc., Mar. 19, 2001.
Website page for Animated Software Co. "The Internet Glossary of Pumps", www.animatedsoftware.com, Apr. 2, 2001.
Product Information Sheet "550 Series Super Flow Pump", Aquatec Water Systems, Inc., Mar. 22, 2001.
Shurflo Brochure, "Valve Assembly Replacement Model 2XX/21XX", Oct. 1981.

* cited by examiner

BILGE PUMP

CROSS REFERENCE TO RELATED APPLICATIONS

This application is a continuation application of U.S. patent application Ser. No. 10/013,311, filed Nov. 12, 2001, now U.S. Pat. No. 6,715,994 issued on Apr. 6, 2004.

FIELD OF THE INVENTION

The invention relates to pumps, and more particularly to pumps for pumping bilge liquids from a vessel.

BACKGROUND OF THE INVENTION

Bilge pumps are employed to remove water and other liquids from boats and are typically mounted in the boat's engine compartment or bilge area. Installation of bilge pumps is often relatively difficult due to the tight quarters of the engine compartment or bilge area. Mounting the bilge pump to the hull, connecting the electrical wiring, and connecting the pump outlet to the drain conduit are all complicated by the confined working space. Replacing an inoperable bilge pump may even be more difficult. Replacement bilge pumps usually have a mounting footprint and overall configuration that is different from the original pump. The boat's wiring and drain conduit, which were designed to accommodate the original bilge pump, may not correspond with the locations of the respective connector and outlet port on the replacement pump.

Another problem of existing bilge pumps is related to the manner in which such pumps turn on and off. Specifically, many bilge pumps have a sensor or switch which responds to the level of water in the surrounding environment by turning the bilge pump on and off. Unfortunately, such sensors or switches can react to movement of the boat (and water in the hull) by turning the pump on when the amount of water in the hull is low and/or by turning the pump off when the amount of water in the hull is high.

In light of the problems and limitations of the prior art described above, a need exists for a bilge pump having a versatile and adaptable configuration. Each preferred embodiment of the present invention achieves one or more of these results.

SUMMARY OF THE INVENTION

Some embodiments of the present invention alleviate the problems associated with installing new or replacement bilge pumps in confined spaces and with aligning the operative features of the bilge pump (i.e., the electrical leads and the pump outlet nozzle) with the corresponding operative features of the boat (i.e. the electrical supply leads and the drain conduit). The present invention provides a bilge pump that is adaptable to facilitate installation in the boat and to facilitate connection of the bilge pump to the operative features of the boat. The present invention also provides a method for installing and connecting a bilge pump in a boat.

More specifically, one preferred embodiment of the invention provides a bilge pump having a mounting member adapted to be mounted to a vessel and a base movably engageable with the mounting member and positionable in at least two positions relative to the mounting member. Preferably, the mounting member includes a flange and the base includes a lip engageable with the flange so that the base is retained by the flange for rotation with respect to the mounting member.

In another aspect of the invention, a housing is releasably coupled to the base. The housing defines a cavity for receiving a motor. A locking ring is engageable with the motor and the housing to secure the motor in the cavity while allowing the motor to be movable with respect to the housing. In yet another aspect of the invention, the cavity in the housing communicates with an outlet portion that defines a socket. An outlet nozzle having an outlet end is movably received in the socket so that the outlet end can be moved relative to the housing. These aspects, employed individually or in combination, make the bilge pump highly adaptable and facilitate installation.

The invention also provides a method of installing a bilge pump in a vessel. In one preferred embodiment, the method includes positioning a base in the vessel, positioning a mounting member adjacent to a portion of the base to engage at least a portion of the base and a portion of the vessel, and coupling the mounting member to the vessel to movably secure the base to the vessel. Preferably, a housing is coupled to the base. The housing includes an outlet portion and a cavity having a motor received therein. An electrical lead extends from the motor to be connected to an electrical lead in the vessel. The method further includes moving, and preferably rotating, the housing and the base with respect to the vessel to position the outlet portion with respect to the vessel for connection to a drain conduit. The method also preferably includes moving the housing and the base to position the motor electrical lead with respect to the vessel for connection to the vessel electrical lead.

In another aspect of the invention, the outlet portion defines a socket that supports an outlet nozzle having an outlet end. The method further includes moving the outlet end with respect to the vessel to facilitate connection of the outlet end to the drain conduit. In yet another aspect of the invention, the method includes rotating the motor in the cavity to position the motor electrical lead with respect to the vessel to facilitate connection to the vessel electrical lead.

Some embodiments of the present invention employ a control assembly which functions to turn the pump on only after the control assembly detects a rise in water level to a predetermined height that is sustained for a period of time (in order to avoid pump cycling or premature pump start resulting from water movement within the vessel hull). Preferably, a control assembly is employed that has two switches and/or two sensors—one for detecting a high water level in order to turn the pump on, and one for detecting a low water level in order to turn the pump off.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings.

It is to be understood that the phraseology and terminology used herein is for the purpose of description only and should not be regarded as limiting. The use of "including" and "comprising" and variations thereof herein is meant to encompass the items listed thereafter and equivalents thereof as well as additional items. Unless otherwise stated, the order in which steps of a method or process are listed is not meant to indicate that the steps should be performed in a particular order.

DETAILED DESCRIPTION OF THE PREFERRED EMBODIMENT

Figure 2:
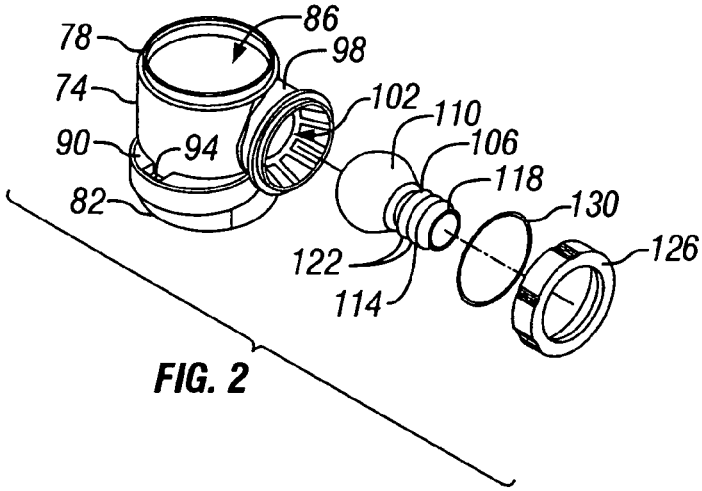
FIG. 2 is an exploded perspective view showing the outlet nozzle assembly of the bilge pump shown in FIG. 1.
Figure 3:
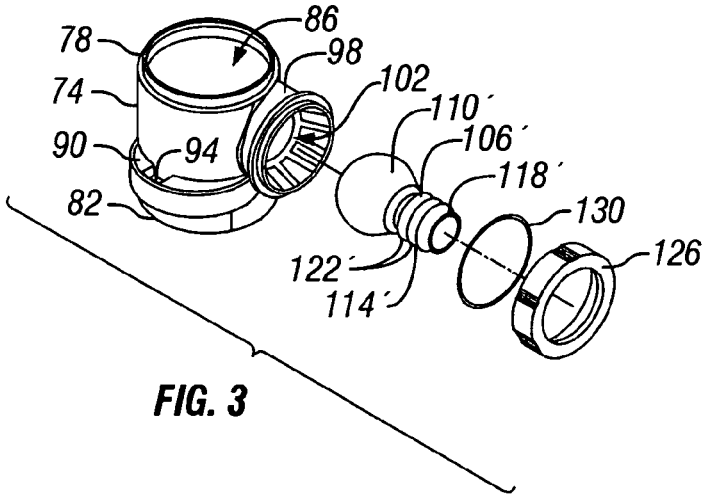
FIG. 3 is an exploded perspective view of an alternative outlet nozzle assembly having a larger outlet nozzle than the outlet nozzle assembly shown in FIG. 2.
Figure 4:
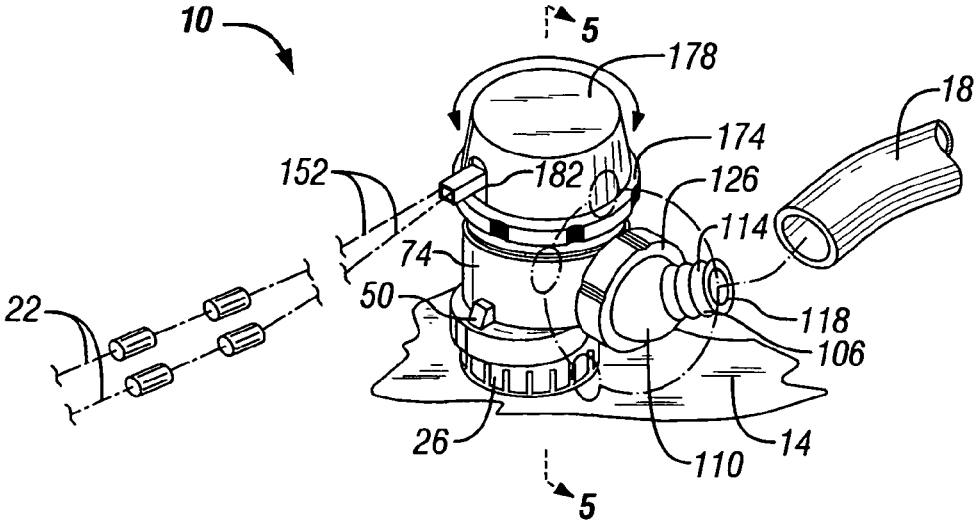
FIG. 4 is a perspective view showing the bilge pump of FIG. 1 in its assembled state.

FIGS. 1-6 illustrate a bilge pump 10 embodying the present invention. The bilge pump 10 is intended for use in a boat or vessel (not shown), however, the bilge pump 10 can also be used with other applications that utilize a pump. As seen in FIG. 4, the vessel includes a mounting surface 14, a drain conduit 18, and at least one electrical power supply lead 22. The mounting surface 14 is typically located in the bilge or engine compartment of the vessel, however the mounting surface 14 can also be found in other locations, such as in a live well. As used herein and in the appended claims, the term "drain conduit" refers to a piece of hose, tubing, piping, or other similar material that defines a pathway for fluid to travel from an interior portion of the vessel to an exterior portion of the vessel, as is well-known to those skilled in the art.

In the illustrated embodiment, the bilge pump 10 includes a base 26 having a peripheral wall 30. A plurality of apertures 34 are formed in the peripheral wall 30 and allow fluid to pass through the peripheral wall 30. A lip 38 extends radially inwardly from the lower end of the peripheral wall 30. The lip 38 defines a central aperture 42. A pair of diametrically opposed resilient arms 46 extend upwardly from the upper end of the peripheral wall 30. Each arm 46 preferably includes a locking projection 50. The purpose of the lip 38, the aperture 42, and the locking arms 46 will be described below.

Figure 1:
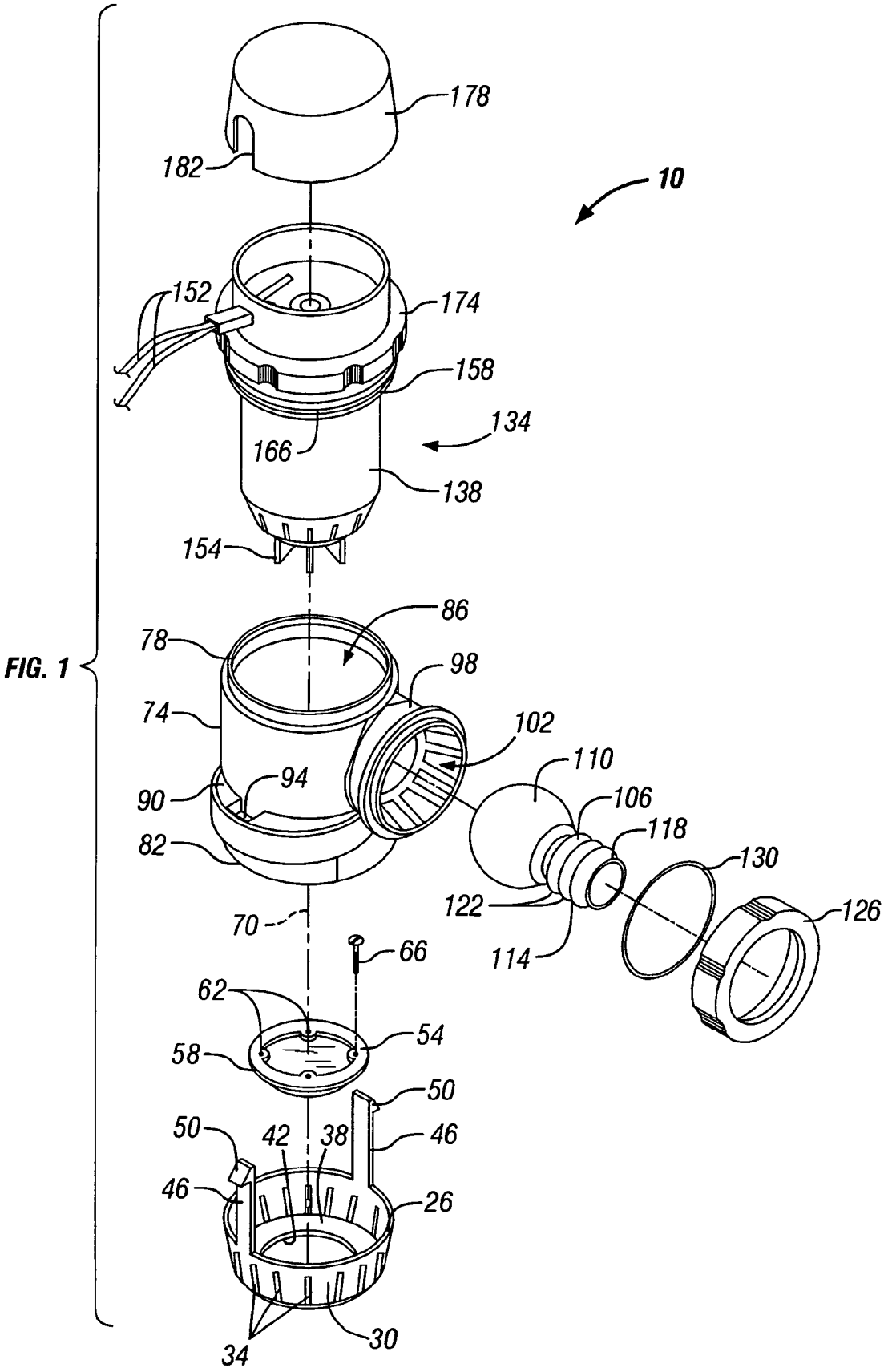
FIG. 1 is an exploded perspective view of a bilge pump according to a preferred embodiment of the present invention.
Figure 5:
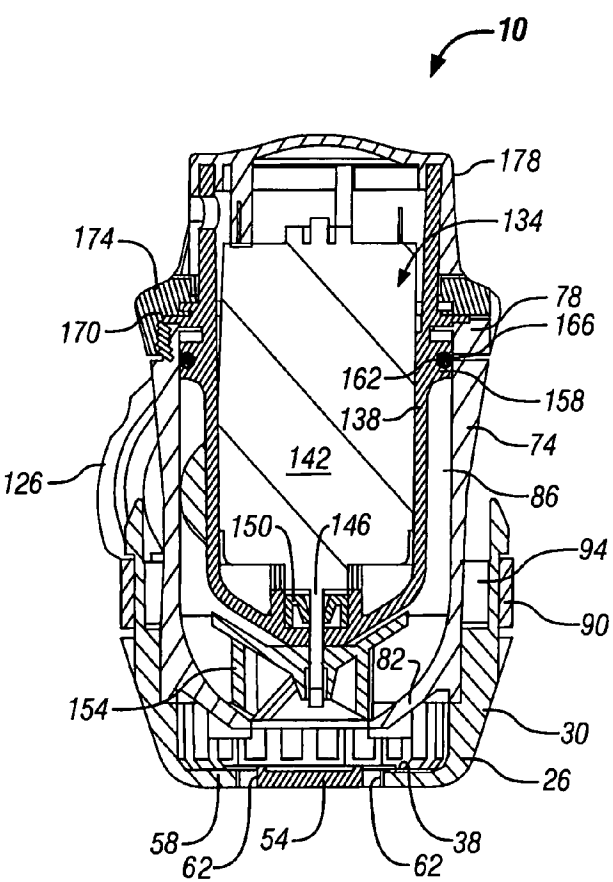
FIG. 5 is a section view taken along line 5-5 in FIG. 4.

The bilge pump 10 also includes a mounting member 54. The mounting member 54 is preferably a disc-shaped member having a flange 58 (see FIGS. 1 and 5) that extends radially outwardly around an upper portion of the circumference of the mounting member 54. In the illustrated embodiment, the mounting member 54 also includes a plurality of holes 62 for receiving fasteners 66 (only one is shown in FIG. 1). As best seen in FIG. 5, the mounting member 54 is sized to be partially received in the central aperture 42 of the base 26 to mount the mounting member 54 and the base 26 to the mounting surface 14 of the vessel. When the mounting member 54 is secured to the mounting surface 14, the flange 58 engages the lip 38 to movably retain the base 26. The engagement between the flange 58 and the lip 38 is such that the base 26 can be rotated about an axis 70 (see FIG. 1) with respect to the mounting member 54, and thus the base 26 can be positioned in at least two different positions relative to the mounting member 54 and the vessel.

While one preferred embodiment of the mounting member 54 is illustrated, it is understood that the mounting member 54 can take various other forms. Of course, changing the configuration of the mounting member 54 will likely necessitate changing the configuration of the base 26. For example, the flange 58 could be replaced by one or more tabs or projections (not shown) adapted to be received in a groove or recess (not shown) formed in the lip 38. When inserted into the groove or recess, the engagement between the tabs or the projections and the groove or the recess would allow the base 26 to be rotated about the axis 70.

Other known engagement arrangements that provide for the relative rotation of two components can also be used. For example, the mounting member can be a ball bearing or roller bearing capable of having a first portion secured to the mounting surface 14 and a second portion that is movable relative to the first portion, so that when the second portion is coupled to the base 26, the same rotatability of the base 26 is achieved. Alternatively, magnetic attraction could be used between the mounting member and the base. The magnetic force would normally fix the base with respect to the mounting surface, however, the installer could move or rotate the base with respect to the axis 70 by temporarily overcoming the magnetic force. Of course, these types of mounting members can be separate parts or can be integrally formed with the base 26.

Finally, it should be noted that the mounting member need not be configured to provide for the rotation of the base 26, but rather could simply be used to fix the base relative to the mounting surface 14. Again, the mounting member could be a separate part or could be integral with the base. For example, a mounting member similar to the mounting member 54 could be used, but could be configured such that once it is tightly secured to the mounting surface 14, the base 26 cannot rotate about the axis 70. Alternatively, the lip 38 of the base 26 can be made into the mounting member by passing fasteners through the lip 38 and directly into the mounting surface 14.

The bilge pump 10 further includes a housing 74 that is coupled to the base 26. The housing 74 is substantially tubular and includes an upper open end 78 and a lower open end 82 (see FIG. 1). As used herein, the terms "upper" and "lower" are used for purposes of description only and are not intended to imply any particular orientation. The housing 74 defines a cavity 86 that extends between the upper and lower open ends 78, 82. The housing 74 also includes a radial flange 90 having apertures 94 extending therethrough for receiving the locking arms 46 of the base 26. The locking arms 46 are inserted into the apertures 94 until the locking projections 50 exit the apertures 94 and snap outwardly over the flange 90 to secure the housing 74 to the base 26. Of course, other securing arrangements can be used to secure the housing 74 to the base 26. For example, threaded engagements, fasteners, adhesives, and other known fastening techniques can also be used.

When the housing 74 is secured to the base 26, both the housing 74 and the base 26 are movable with respect to the securing surface 14 and the mounting member 54. In other words, both the housing 74 and the base 26 are rotatable about the axis 70 (as indicated by the arrow in FIG. 4). As will be described in more detail below, installation and connection of the bilge pump 10 is facilitated due to the ability to rotate the base 26 and the housing 74 about the axis 70 while the bilge pump 10 is coupled to the securing surface 14.

The housing 74 also includes an outlet portion 98 in fluid communication with the cavity 86. In the illustrated embodiment, the outlet portion 98 defines a socket 102. An outlet nozzle 106 is configured to be received in the socket 102 and is ultimately coupled to the drain conduit 18 to expel fluid out of the vessel. In the illustrated embodiment, the outlet nozzle 106 includes a ball portion 110 sized to be received in the socket 102. Together, the socket 102 and the ball portion 110 define a ball-and-socket connection (see FIG. 6).

The outlet nozzle 106 also includes a connection portion 114 extending from the ball portion 110. The connection portion 114 includes an outlet end 118 where fluid exits the outlet nozzle 106. The ball-and-socket connection enables the outlet nozzle 106 to be moved with respect to the housing 74 (as indicated by the circular pathway shown in phantom in FIG. 4) so that the outlet end 118 can be positioned as desired with respect to the housing 74 and the vessel. The movable outlet nozzle 106 facilitates the connection of the outlet nozzle 106 and the drain conduit 18 and provides greater flexibility than bilge pumps having fixed outlet nozzles. In the illustrated embodiment, the connection portion 114 also preferably includes ridges 122 for engaging the inner surface of the drain conduit 18. Of course, other types of engagement between the outlet end 118 and the drain conduit 18 can also be used, including snap-lock engagements, quick-disconnect engagements, and threaded engagements.

Figure 6:
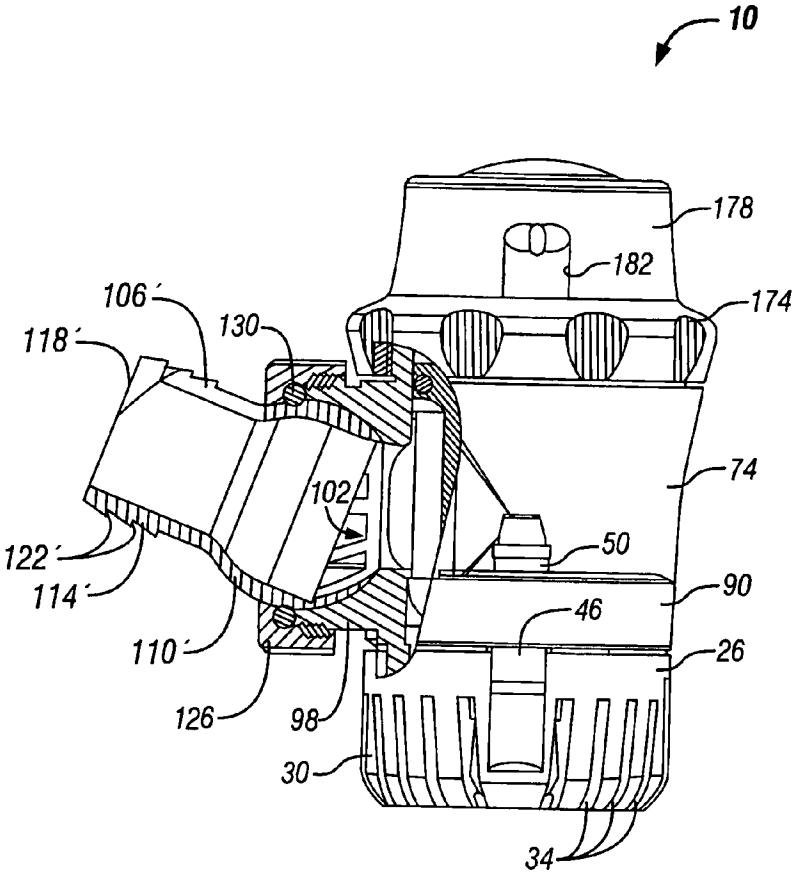
FIG. 6 is a partial section view showing the engagement of the outlet portion and the outlet nozzle.

The bilge pump 10 also includes a retainer in the form of a locking ring 126 that secures the outlet nozzle 106 in the socket 102. As best seen in FIG. 6, the locking ring 126 threadedly engages the outlet portion 98 and also engages the ball portion 110 to movably retain the outlet nozzle 106 in the socket 102. Preferably, the locking ring 126 can be tightened such that the desired position of the outlet nozzle 106 is maintained. A sealing ring 130 is preferably inserted between the locking ring 126 and the ball portion 110 to substantially prevent leakage from the ball-and-socket connection.

FIG. 3 illustrates an alternative outlet nozzle 106'. The parts of the alternative outlet nozzle 106' corresponding to the parts of the outlet nozzle 106 are given reference numerals having the (') symbol. The outlet nozzle 106' is substantially the same as the outlet nozzle 106 except that the connection portion 114' is larger than the connection portion 114 in order to be connected to a larger diameter drain conduit (not shown). The ball portion 110' is substantially the same size as the ball portion 110 so that the outlet nozzles 106 and 106' are interchangeable with one another. The interchangeability of the outlet nozzles 106 and 106' provides greater flexibility for installing the bilge pump 10 because the size of the drain conduit 18 may vary from vessel to vessel. While only two different outlet nozzles 106 and 106' are shown, it is understood that other outlet nozzles having connection portions of other sizes or having other types of drain conduit engagement mechanisms are also contemplated by the invention.

Figure 7:
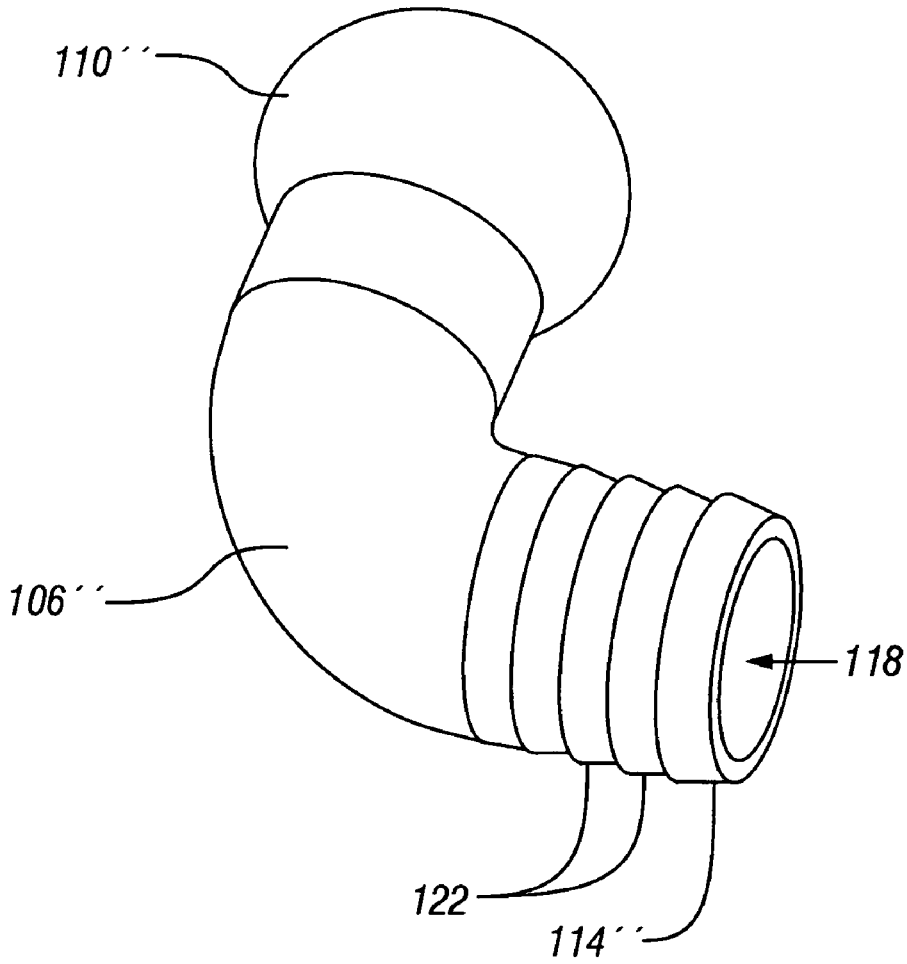
FIG. 7 is a perspective view of an alternative outlet nozzle according to the present invention.

FIG. 7 illustrates yet another alternative outlet nozzle 106". The parts of the second alternative outlet nozzle 106" corresponding to the parts of the outlet nozzle 106 of the embodiment shown in FIG. 2 are given reference numerals having the (") symbol. The outlet nozzle 106" is substantially the same as outlet nozzles 106 and 106', with the exception that the outlet nozzle 106" is angled so that the outlet end 118" of the outlet nozzle 106" is at an angle with respect to that portion of the outlet nozzle 106" connected to the pump housing 174. The outlet nozzle 106" can be placed in this shape in any manner desired, including without limitation by bending, casting, molding, extruding, or machining the outlet nozzle 106". This shape of the outlet nozzle 106" permits easier connection of the outlet nozzle 106" to a drain conduit (not shown) despite barriers which may be present adjacent to the outlet nozzle 106", such as an interior wall of the vessel hull, one or more vessel frame members, equipment in the vessel hull, and the like. The outlet end 118" of the outlet nozzle 106" can be at a right, acute or obtuse angle with respect to the rest of the outlet nozzle 106" depending at least in part upon the desired orientation of the drain conduit (not shown) and its connection to the bilge pump 10.

Although the illustrated preferred outlet nozzle 106" has only one angle or bend, alternative outlet nozzles can further include additional angles or bends as desired. Furthermore, the ball portion 110" is preferably substantially the same size as the ball portions 110 and 110' so that the outlet nozzles 106, 106' and 106" are interchangeable with one another. Although this interchangeability is not required, it increases the versatility of the bilge pump and its use in different applications.

The outlet nozzle 106" illustrated in FIG. 7 also differs from those of FIGS. 2 and 3 by having a varying diameter along the length thereof (from the ball portion 110" to the end of the outlet nozzle 106"). Specifically, the interior of the outlet nozzle 106" preferably tapers or otherwise narrows with increasing distance from the ball portion 110", thereby providing for a smooth flow transition and/or flow acceleration toward the drain conduit attached to the outlet nozzle 106". The outlet nozzle 106" can taper gradually along any part or all of the length of the outlet nozzle 106", or can narrow by one or more interior steps, concave or convex interior wall profiles, or in any other manner.

The bilge pump 10 also includes a motor assembly 134 including (see FIG. 5) a motor housing 138. The motor housing 138 houses a motor 142. An output shaft 146 extends from the motor 142 and through the motor housing 138. A shaft seal 150 surrounds the output shaft 146 and is retained inside the motor housing 138. At least one electrical lead 152 (see FIGS. 1 and 4) extends from the motor 142 and through the motor housing 138 at the end opposite the output shaft 146. The electrical leads 152 are adapted to be connected to the electrical power supply leads 22 to provide power to the motor 142.

The motor assembly 134 further includes an impeller 154 coupled to the output shaft 146. When the motor assembly 134 is positioned in the cavity 86, rotation of the output shaft 146 rotates the impeller 154 to pump fluid in the space between the motor housing 138 and the interior wall of the housing 74 out of the housing 74 through the outlet portion 98.

In order to help evacuate air from the housing 74 during operation of the pump 10, some preferred embodiments of the present invention have at least one rib that extends from an interior wall of the housing 74 toward the interior of the housing 74. Preferably, a plurality of ribs are employed for this purpose, such as three equally-spaced ribs 77''' in the housing embodiment illustrated in FIG. 8 (only two of the three ribs 77''' are visible in FIG. 8). The ribs 77''' are employed to generate turbulence in the fluid within the housing 74''', thereby permitting the pump 10 to evacuate air that may be trapped within the housing 74'''. Although ribs 77''' are only illustrated in the FIG. 8 embodiment, it should be noted that ribs 77''' (or other protrusions as described in greater detail below) can be employed in any embodiment of the present invention.

Figure 8:
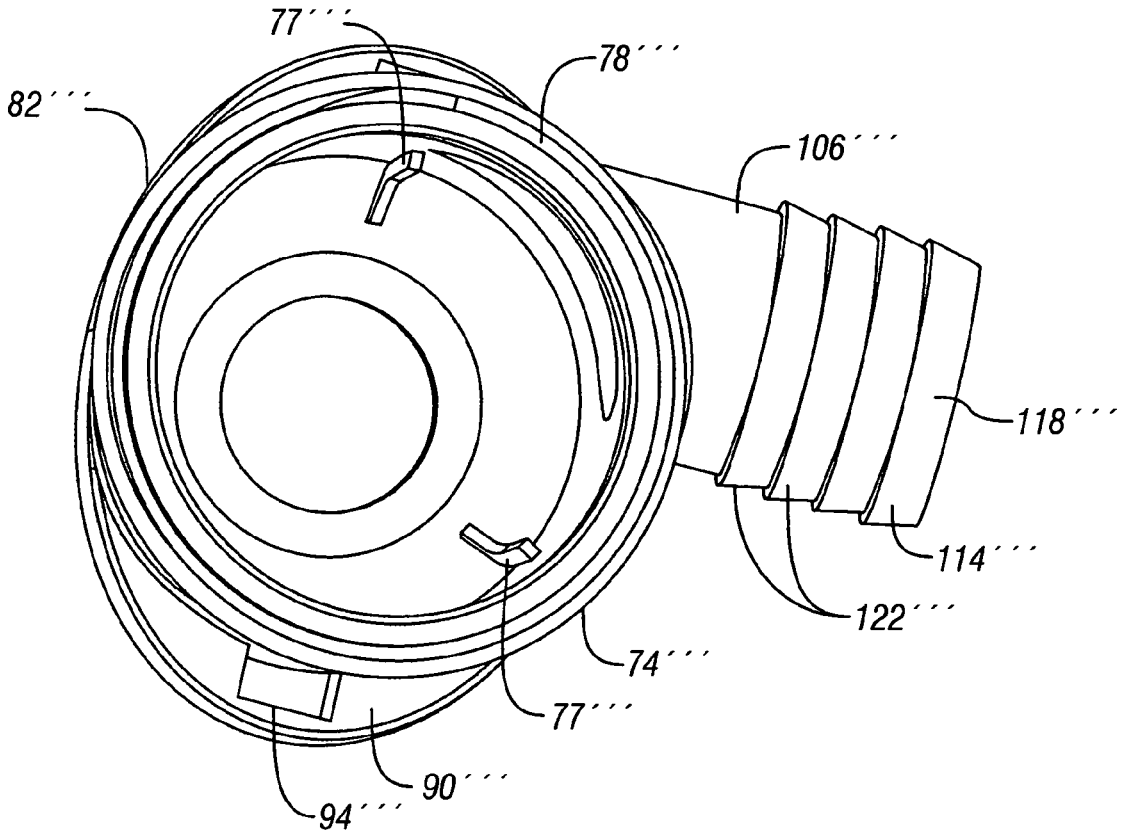
FIG. 8 is a perspective view showing an alternative outlet nozzle and housing according to the present invention.

The ribs 77''' can be any shape desired, such as the wall-shaped ribs 77''' illustrated in the FIG. 8 housing embodiment. Other protrusions can extend from the interior surface of the housing 74''', such as walls, posts, fingers, bumps, ramps, ridges, and other elements. Such elements can be equally or unequally spaced about the interior of the housing 74'''. Although any protrusions can be employed to create turbulence within the housing 74''' as described above, the wall-shaped ribs 77''' are preferred for their ability to efficiently generate the desired turbulence.

As best seen in FIG. 5, the motor housing 138 includes a radially-extending flange 158 having therein a groove 162 for retaining a sealing ring 166. When the motor assembly 134 is inserted into the cavity 86 through the upper open end 78 of the housing 74, the sealing ring 166 sealingly engages the interior wall of the housing 74 to substantially prevent fluid from leaking out of the upper open end 78 of the housing 74. The flange 158 and sealing ring 166 also function to substantially center the motor assembly 134 in the cavity 86.

Still referring to FIG. 5, the motor housing 138 also includes a second radially-extending flange 170 that is preferably just above the flange 158. The flange 170 is sized to engage the upper open end 78 of the housing 74 when the motor assembly 134 is inserted into the cavity 86. Therefore, the flange 170 acts as a stop to indicate when the motor assembly 134 is fully inserted into the cavity 86.

The bilge pump 10 also includes a retainer in the form of a locking ring 174 that fits over the motor housing 138. As best seen in FIG. 5, the locking ring 174 is configured to engage the flange 170 and to threadedly engage the upper open end 78 of the housing 74 to retain the motor assembly 134 in the cavity 86. When the locking ring 174 is screwed tightly to the upper open end 78, the motor assembly 134, and therefore the motor 142, are substantially prevented from rotating about the axis 70 while inside the cavity 86.

However, when the locking ring 174 is only partially screwed onto the upper open end 78, or when the locking ring is not yet threadedly engaged with the upper open end 78, the motor assembly 134, and therefore the motor 142, can be rotated about the axis 70 while inside the cavity 86. This relative movement between the housing 74 and the motor assembly 134 facilitates connecting the electrical leads 152 to the electrical power supply leads 22 by allowing the installer to position the motor housing 138 so that the exit location of the electrical leads 152 is suitably positioned with respect to the vessel and the electrical power supply leads 22.

It should be noted that other retainers using other fastening techniques could be substituted for the locking ring 174. Such other fastening techniques could include various snap-fit arrangements or bayonet-type locking arrangements that would permit the motor housing to be rotationally locked or unlocked with respect to the housing 74.

The bilge pump 10 also preferably includes a motor cover 178 that fits on the end of the motor housing 138 opposite of the impeller 154. In the illustrated embodiment, the motor cover 178 includes a notch 182 that provides clearance for the electrical leads 152. The motor cover 178 is sized to be press-fit onto the motor housing 138 by hand so that no other securing steps are necessary. Of course, the motor cover 178 can be secured to the motor housing 138 with an adhesive or any other suitable fastener.

The components of the bilge pump 10 can be made from any materials suited for use in the wet environment of a bilge, a motor compartment, or any other location from which fluid must be evacuated. In the illustrated embodiment, the base 26, the mounting member 54, the housing, the outlet nozzle 106, 106', 106" the locking rings 126 and 174, the motor housing 138, the impeller 154 and the motor cover 178 are all plastic, however, other suitable materials can also be used.

The installation and connection of the bilge pump 10 will now be described. First, the installer locates the position where the bilge pump 10 is to be mounted. In a new vessel, the position will be dictated, in part, by the location of the drain conduit 18 and the electrical power supply leads 22. If the bilge pump 10 is used to replace an old pump, the position will likely be near the mounting location of the pump that is being replaced. Once the mounting area is clear of debris and other obstructions, the base 26 is placed on the mounting surface 14 and the mounting member 54 is inserted into the central aperture 42 and fastened to the mounting surface 14. When the mounting member 54 is secured to the mounting surface 14, the flange 58 engages the lip 38 to movably retain the base 26, as described above.

Next, and in no particular order, the installer selects the desired outlet nozzle 106, 106' 106" inserts the ball portion 110, 110', 110" into the socket 102, and secures the outlet nozzle 106, 106', 106" to the housing 74 with the locking ring 126 and the sealing ring 130. Of course, the outlet nozzle 106, 106' or 106" may have been previously installed in the socket 102.

The installer also inserts the motor assembly 134 into the cavity 86, as described above. Preferably, the locking ring 174 is not yet completely screwed down, thereby leaving the motor assembly 134 free to rotate about the axis 70.

The installer then secures the housing 74, which currently houses the motor assembly 134 and is connected to the outlet nozzle 106, 106', 106", to the base 26 by aligning the locking arms 46 with the apertures 94 and inserting the locking arms 46 into the apertures 94 until the projections 50 engage the flange 90, as described above. It is to be understood that the installer can vary the order of the previous steps as desired, depending on the space availability in the working area. For example, the installer could couple the housing 74 to the base 26 prior to connecting the outlet nozzle 106, 106', 106" and/or inserting the motor assembly 134 into the cavity 86.

Next, the installer can adjust the positioning of the bilge pump 10 as desired using the various adjustment features discussed above, in order to facilitate connecting the outlet nozzle 106, 106', 106" to the drain conduit 18 and to facilitate connecting the electrical leads 152 to the electrical power supply leads 22. For example, the installer might first rotate the base 26 and the housing 74 about the axis 70 so that the outlet portion 98 is positioned near the drain conduit 18. Next, the outlet nozzle 106, 106', 106" can be positioned with respect to the housing via the ball-and-socket connection so that the connection portion 114 is oriented to best accept engagement with the drain conduit 18. At this point, the installer can couple the drain conduit 18 to the connection portion 114.

With the drain conduit 18 connected, the installer can then rotate the motor assembly 134 with respect to the housing 74 so that the electrical leads 152 exit the motor housing 138 in close proximity to the electrical power supply leads 22. Once properly positioned, the motor assembly 134 can be locked down with the locking ring 174. Finally, the motor cover 178 can be placed on the end of the motor housing 138.

Preferably, the connection of the bilge pump 10 to the electrical power supply leads 22 and the drain conduit 18 will serve to minimize further rotation of the base 26 and the housing 74 about the axis 70 during the life of the bilge pump 10. Of course, once installed and connected, the bilge pump 10 could be positively anti-rotated using any suitable anti-rotation mechanism. For example, a pin or dowel (not shown) could be secured to the mounting surface 14 and inserted into one of the apertures 34 so that the base 26 could no longer rotate about the axis 70.

The bilge pump of the present invention can be controlled in a number of different manners, such as by a manually-operated switch, button, or other user-manipulatable control, by one or more fluid sensors which detect the presence of fluid at the location of the bilge pump (and which in some cases can detect the level of fluid at the bilge pump), by a switch (e.g., a float switch) which responds to surrounding fluid levels by turning the bilge pump on and off, and the like.

Figure 9:
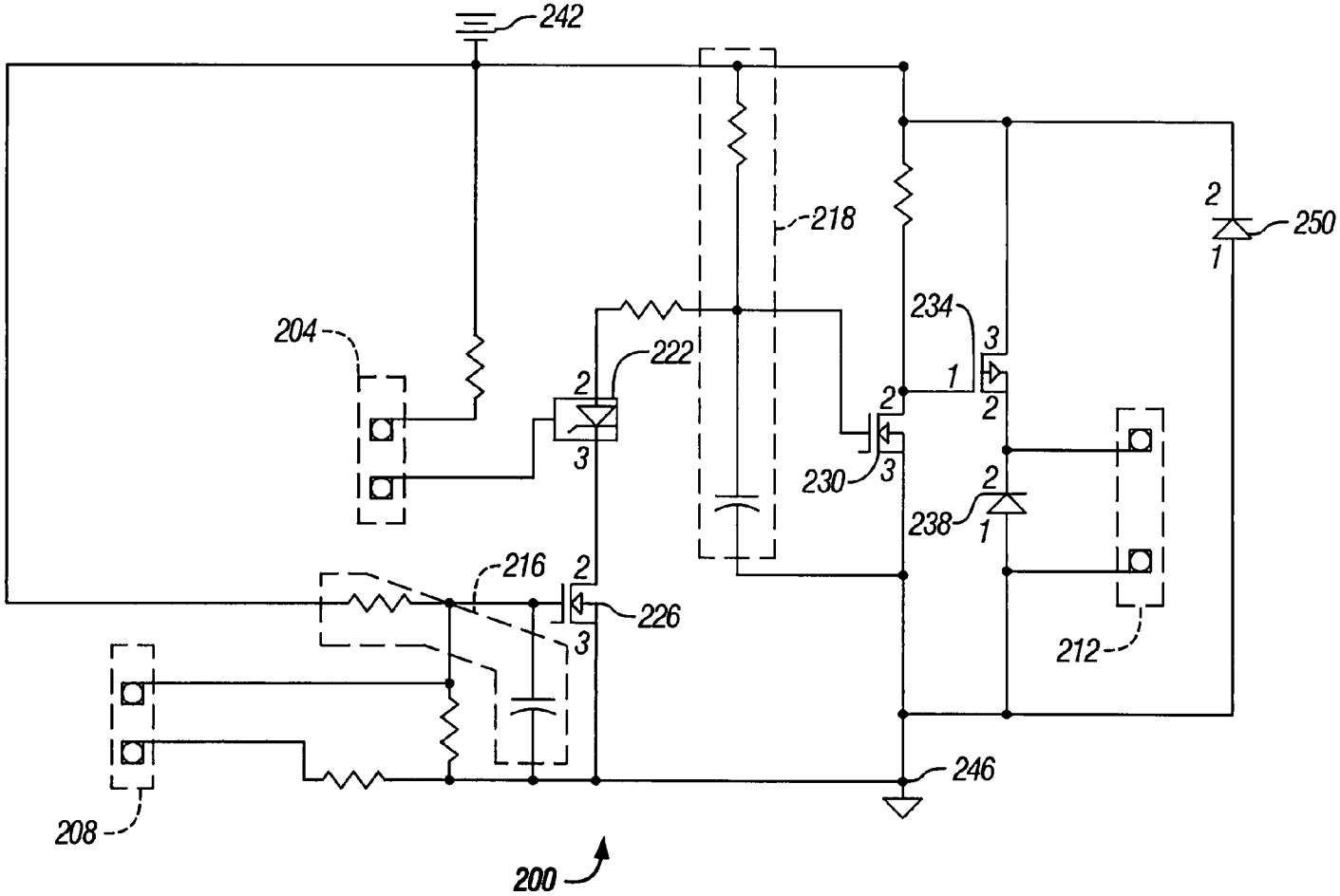
FIG. 9 is an schematic electrical circuit diagram of the bilge pump control assembly according to one preferred embodiment of the present invention.

In some preferred embodiments of the present invention, the bilge pump 10 employs a control assembly 200 which automatically turns the bilge pump 10 on and off responsive to the level of water at the bilge pump 10. One such control assembly 200 is illustrated in FIG. 9 by way of example only. The bilge pump control assembly 200 preferably automatically activates and deactivates the bilge pump motor 142 based upon the position of a float (not shown). The float is preferably conventional in nature, and can take any number of different forms well known to those skilled in the art. For example, the float can be made partially or entirely from floating material (such as Styrofoam, for example), can be defined by a floating element or structure (such as one or more air-filled bulbs, chambers, and the like), or can take any other form used for floats. The float can be located at the end of a cantilevered and pivotable arm, can slide up and down upon a rod, or can move with the level of water in any other conventional manner. The float can be located outside or inside the pump housing or within a separate housing unit, but most preferably is located within a separate housing unit attached to the housing 74 by clips, fasteners, a snap-fit, and the like.

The control assembly 200 preferably includes switches 204 and 208 and a motor connection 212 for coupling the control assembly 200 to the motor 142 (shown in FIG. 5). In some preferred embodiments, the above-described float has a magnet that moves with the float. In such embodiments, the switches 204 and 208 are vertically spaced from one another and are preferably responsive to the magnetic field of the magnet to open or close depending upon the presence or absence of the float and magnet adjacent to the switches 204, 208. In this manner, the float height of the float (and magnet) preferably opens and closes the switches 204, 208 to thereby control the current output to the motor 142 based on the position of the float.

The switches 204, 208 can be of any type, and in the illustrated preferred embodiment are preferably reed-type switches. The type of switch 204, 208 employed is dependent at least in part upon the manner in which the switch 204, 208 is activated by the rise or fall of the water level at the bilge pump 10. For example, the switch 204, 208 can be mechanically tripped by a rising or falling float, can be responsive to and activated by a magnetic field as discussed above, or can be activated in any number of other manners, each of which falls within the spirit and scope of the present invention.

Preferably, one switch 204 is triggered by the float magnet (not shown) when the water level at the bilge pump 10 is low. Triggering this switch 204 preferably limits the current to the motor connection 212, which deactivates motor 142. Switch 208 is preferably triggered when the water level at the bilge pump 10 is high. Triggering this switch 208 preferably causes current to be supplied to the motor connection 212, which in turn activates motor 142.

With continued reference to FIG. 9, the control assembly 200 preferably includes two RC circuits 216 and 218 as well as a plurality of transistors and resistors which enable switches 204 and 208 to control the current output.

When the float (not shown) drops to a certain level, switch 204 is activated in order to deactivate motor 142. More specifically, when the switch 204 is triggered, transistors 222 and 226 are turned on. In other words, transistors 222 and 226 are placed in a saturation state, which allows current to pass. Activating transistors 222 and 226 causes transistors 230 and 234 to turn off or to be in a cut-off state, which limits passing current. Once transistors 230 and 234 are in the cut-off state, no current passes through motor connection 212, and power is thereby cut off to motor 142. Preferably diode 238 discharges any current left once transistor 234 is turned off.

When the float (not shown) raises to a predetermined level (corresponding to a water level at which it is desired to begin pumping water with the bilge pump 10), switch 208 is preferably triggered in order to activate motor 142. When the switch 208 is triggered, transistors 222 and 226 are turned off, thereby activating the motor 142. However, the transistors 222 and 226 do not change states unless the switch 208 is triggered for a period of time. This period of delay prevents the transistors 222 and 226 from switching states and prevents the motor 142 from activating as a result of a wave or surge of water at the bilge pump 10 (rather than a sustained level of water at the bilge pump 10). Therefore, this delay period prevents undesirable motor and pump cycling when there is a low level of water at or near the bilge pump 10.

A number of different elements and assemblies can be employed to generate a delay period as described above. In the illustrated preferred embodiment for example, RC circuits 216 and 218 are used to delay the state change of transistors 222, 226, 230 and 234. In one embodiment, the RC circuits 216 and 218 require that switch 208 be activated for a period of approximately two seconds. If the switch is activated for this time period, the transistors 216 and 222 turn to the cut-off state, causing the transistors 230 and 234 to turn to the saturation state. Once the transistors 230 and 234 turn on, current is supplied through the motor connection 212 and power is supplied to motor 142.

The resistors and capacitors of the RC circuits 216 and 218 can be selected to require any amount of delay prior to the transistors 216 and 222 turning to the cut-off state. Although a two-second delay is highly desirable, a shorter or longer delay can be employed as needed. Preferably, the RC circuits 216, 218 are selected so that the delay period is between at least 1 second and one minute. More preferably, the RC circuits 216, 218 are selected so that the delay period is between at least one 1 second and 10 seconds. Most preferably, the RC circuits 216, 218 are selected so that the delay period is about 2 seconds.

In the illustrated preferred embodiment, the transistors 226 and 230 are MOSFETs (metal-oxide semiconductor field-effect transistor), the transistor 234 is a P-channel MOSFET, and the transistor 222 is a silicon-controlled rectifier. One having ordinary skill in the art will appreciate that other transistors can instead be used. By way of example only, any of the transistors can be bipolar junction transistors or other field-effect transistors.

The assembly 200 is preferably connected to a grounded connection 246 and to a power source 242 such as a battery or other DC power source. In alternative embodiments, control assemblies 200 connected to alternating current power sources are possible. A reverse polarity protection diode 250 can be positioned to limit and discharge the current if the current reverses in the circuit.

The control assembly 200 illustrated in FIG. 9 is highly preferred for purposes of reliability and ease of manufacture. However, one having ordinary skill in the art will appreciate that the functions performed by the control assembly 200 as described above can be performed by a number of circuits and electronic assemblies. For example, the bilge pump control assembly in other embodiments can include a microprocessor or can utilize other combinational logic components to perform the above-described functions, including the creation of a delay following activation of the switch 208. Such alternative control assemblies 200 and control assembly components fall within the spirit and scope of the present invention.

Although the control assembly 200 preferably has two switches 204, 208 as described above, it will be appreciated that the power to the motor 142 can be controlled by using only one switch which is triggered on by the rise of a float past a predetermined height and is triggered off by the fall of a float past a predetermined height. Preferably, such a switch employs the delay circuitry described above in order to prevent cycling of the motor 142 and pump 10. It should be noted that in some alternative embodiments, the delay circuitry described above can be employed to delay cutting power to the motor 142 after a switch detects a low level of water at the bilge pump 10.

In some alternative embodiments of the present invention, the control assembly 200 employs one or more sensors connected to either or both switches 204, 206 to activate and deactivate either or both switches 204, 206. The sensor(s) can be of any type, including optical, temperature, pressure, and other sensors, and can be positioned on or with respect to the bilge pump 10 to detect when the water level at the bilge pump 10 reaches one or more predetermined heights. When such water level(s) are detected, the sensor(s) can transmit one or more signals to the switches 204, 206 to trigger the switches 204, 206 to open or closed positions as desired.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the bilge pump 10 of the illustrated embodiment includes multiple features suited for adjusting the bilge pump 10 during installation. It should be understood that the bilge pump 10 need not have every feature discussed above. Each one of the individual adjustment features constitutes an improvement over the prior art.

In one embodiment, for example, the bilge pump 10 can include an outlet nozzle that is fixed relative to the housing (i.e., no ball-and-socket connection and therefore no interchangeability). An example of such a bilge pump housing 74''' and outlet nozzle 106'''is illustrated in FIG. 8. The parts of this bilge pump shown in FIG. 8 corresponding to the parts of the bilge pump 10''' in the embodiment shown in FIG. 2 are given reference numerals having the (''') symbol.

While a bilge pump employing the outlet nozzle 106''' and housing 74''' illustrated in FIG. 8 may be slightly less flexible than the previously-described embodiments, the ability to rotate the base 26''' and the housing 74''' with respect to the mounting surface 14''' and/or the ability to rotate the motor assembly 134''' with respect to the housing 74''' still provides a significant improvement over prior-art bilge pumps.

In another embodiment, the motor assembly 134 can be fixed relative to the housing 74. Again, while this embodiment may be slightly less flexible than the illustrated embodiment, the ability to rotate the base 26 and the housing 74 with respect to the mounting surface 14 and/or the ability to move the outlet nozzle 106 with respect to the housing 74 still provides a significant improvement over prior art bilge pumps.

In yet another embodiment, the base 26 can be immovably fixed to the mounting surface 14 without the use of the mounting member 54. While this embodiment may be slightly less flexible than the illustrated embodiment, the ability to rotate the motor assembly 134 with respect to the housing 74 and/or the ability to move the outlet nozzle 106 with respect to the housing 74 still provides a significant improvement over prior art bilge pumps.

The invention claimed is:

1. A method of controlling a bilge pump positioned in a boat, the bilge pump including a motor, the method comprising:

raising a float to a first height;

activating a first switch responsive to raising the float to the first height for a period of time greater than two seconds in order to help prevent premature activation of the bilge pump and frequent cycling of the bilge pump during movement of the boat, the first switch connected to at least one transistor that prevents the motor from being activated until the period of time has elapsed;

supplying power to the bilge pump responsive to activation of the first switch for the period of time;

lowering the float to a second height lower than the first height;

activating a second switch responsive to lowering the float to the second height, the second switch being vertically spaced below the first switch; and cutting power to the bilge pump responsive to activation of the second switch.

2. The method of claim 1, wherein the bilge pump includes the at least one transistor connected to an RC circuit and to the first switch, the method further comprising delaying a state change of the transistor for the period of time.

3. The method of claim 1, wherein the first and second switches are reed switches.

4. The method of claim 1, wherein the float includes a magnet, the method further comprising exposing the first switch to a magnetic field of the magnet to activate the first-switch.

* * * * *